US008549818B2

(12) United States Patent
Ehrat et al.

(10) Patent No.: US 8,549,818 B2
(45) Date of Patent: Oct. 8, 2013

(54) PROCESS AND APPARATUS FOR INTRODUCING PRODUCTS INTO CONTAINERS IN A PICKER LINE

(75) Inventors: Matthias Ehrat, Lohn (CH); Jürgen Renner, Blumberg (DE)

(73) Assignee: Veltru AG, Feuerthalen (CH)

( * ) Notice: Subject to any disclaimer, the term of this patent is extended or adjusted under 35 U.S.C. 154(b) by 169 days.

(21) Appl. No.: 12/732,420

(22) Filed: Mar. 26, 2010

(65) Prior Publication Data

US 2010/0242415 A1 Sep. 30, 2010

(30) Foreign Application Priority Data

Mar. 30, 2009 (EP) ..... 09156668

(51) Int. Cl.
*B65B 1/04* (2006.01)

(52) U.S. Cl.
USPC ..... 53/237; 53/249; 53/251; 53/473

(58) Field of Classification Search
USPC ..... 53/237, 240, 244, 249, 250, 251, 53/473, 475
See application file for complete search history.

(56) References Cited

U.S. PATENT DOCUMENTS

| | | | | |
|---|---|---|---|---|
| 4,901,504 | A * | 2/1990 | Tsuji et al. | 53/247 |
| 4,912,904 | A * | 4/1990 | Davis et al. | 53/155 |
| 5,121,589 | A * | 6/1992 | Ventura et al. | 53/448 |
| 5,727,365 | A * | 3/1998 | Lashyro et al. | 53/448 |
| 6,122,895 | A * | 9/2000 | Schubert | 53/55 |
| 6,708,468 | B2 * | 3/2004 | Kondou et al. | 53/501 |
| 6,901,726 | B2 * | 6/2005 | Huppi et al. | 53/473 |
| 7,325,375 | B2 * | 2/2008 | Graushar et al. | 53/397 |
| 7,475,523 | B2 * | 1/2009 | Graushar et al. | 53/397 |
| 7,775,373 | B2 * | 8/2010 | Grundtvig et al. | 209/542 |
| 7,946,429 | B2 * | 5/2011 | Kennedy | 209/655 |
| 8,015,778 | B2 * | 9/2011 | Tischhauser | 53/475 |
| 2001/0049923 | A1 * | 12/2001 | Huppi et al. | 53/473 |
| 2003/0037515 | A1 * | 2/2003 | Herzog | 53/473 |
| 2003/0182898 | A1 * | 10/2003 | Huppi et al. | 53/251 |
| 2004/0079053 | A1 * | 4/2004 | Rohr | 53/473 |
| 2009/0044495 | A1 * | 2/2009 | Aylward | 53/473 |
| 2009/0145670 | A1 * | 6/2009 | Grundtvig et al. | 177/1 |
| 2009/0223878 | A1 * | 9/2009 | Grundtvig et al. | 209/617 |
| 2010/0223883 | A1 * | 9/2010 | Rutschmann | 53/52 |

FOREIGN PATENT DOCUMENTS

| | | |
|---|---|---|
| DE | 10 2006 061 571 | 7/2008 |
| EP | 0856465 | 8/1998 |
| EP | 1717150 | 11/2006 |

* cited by examiner

*Primary Examiner* — Alexandra Elve
*Assistant Examiner* — Eyamindae Jallow
(74) *Attorney, Agent, or Firm* — Shoemaker and Mattare

(57) ABSTRACT

In a process for introducing individual products into containers by means of a picker line comprising at least two pickers individual products are individually picked and transposed to containers. The individual products and the containers are delivered in counterflow on at least one transportation device for the individual products and on at least one transportation device for the containers. The delivery of a next container to be filled into the transposition area of the picker line is controlled by any picker. The picker which is controlling the delivery of the next container to be filled is determined by the number of currently introduced products at the infeed of the picker line.

18 Claims, 7 Drawing Sheets

PROCESS AND APPARATUS FOR INTRODUCING PRODUCTS INTO CONTAINERS IN A PICKER LINE

FIELD OF THE INVENTION

The invention relates to a process and apparatus for introducing individual products into containers in a picker line.

BACKGROUND OF THE INVENTION

The invention concerns a picker line as is used for the transposition of individual products into deposit groups which can accommodate a given number of individual products. In the following instead of the term deposit group the term container is used. The term container here is to be understood less than such as a container, but rather as individual products or a group of individual products that after the transposition by the pickers are placed in a defined position relative to a transportation device and possibly in a defined position within the group of individual products.

The procedure usually involved is such that the individual products are delivered on a product conveyor belt and the containers are delivered on a container conveyor belt and that both the individual products and the containers are transported alongside the pickers which are located in fixed positions. The container conveyor belt can be a transportation device that introduces containers or placing positions with a Cartesian coordinate, either in fixed or variable distance but stationary relative to the transportation device. Container conveyor belts also can be formed by thermoform machines or feeding chains that contain cavities, containers or drivers in fixed, or variable according to the indexing of the belt, distance.

From the perspective of a central control system or the individual controls of each picker of such a picker line, there is no difference whether it concerns containers or cavities or Cartesian placing positions.

In practice, the containers are delivered predominantly on a first transportation device and generally accumulated thereon. Then the containers are transferred from the first transportation device onto a second transportation device, the effective container conveyor belt, on which the respective containers are filled with the appropriate number of individual products, and then, after complete filling of each container, the containers are in turn passed onto a third transportation device for the filled containers to be transported away. However in case of containers or cavities that are stationary relative to the container conveyor belt, in particular cavities of a thermoformer or infeed chains of a flow wrapper, the delivery, filling and removal of the containers is carried out with one transportation device.

DE 42,08,818 C2 discloses a picking line where the pickers are not located in a fixed position relative to the product conveyor or container conveyor but are limitedly and jointly movable in running direction of the conveyors and which are individually movable in orthogonal direction of the conveyors. Thereby the picking of the individual products, and the placing of the individual products into a container can be performed with a moving product conveyor and container conveyor. At the most the product conveyor feeding individual products may be temporarily stopped. This complicates the coupling to a continuously producing production machine for individual products, and only one picker can pick or place a product and not both pickers together. Furthermore there is no advantage visible from the shown arrangement of the product conveyor in cocurrent or concurrent direction.

In contrast, EP 0,749,902 B1 discloses a picker line with which the individual products are counted at the entrance to the picker line in order to release a new container to container conveyor belt when the number of products required to fill a container is achieved. Further it is disclosed that the container conveyor belt and the product conveyor belt are advanced in cocurrent manner or that the container conveyor and the product conveyor are realized as one joint conveyor. It has proved to be particularly problematic that it cannot be ensured that all containers are completely filled when the products are delivered irregularly or on narrow product conveyor belts.

Both documents WO 2004/113030 A1 and EP 1,285,851 A1 seize these problems and disclose a picker line where the individual products also are counted at the entrance of the picker line and where each counted individual product is assigned to a container or a placing position by means of mathematical optimization for loading by a determined picker in the picker line. Such a discrete loading optimization in practice proves to be computation intensive and can likewise not ensure the complete filling of containers in case of irregular or relative to the filling positions per container lower infeed of individual products.

This problem of incomplete filling is raised in DE 29817239 U as well as in EP 1,352,831 B1 where in each case an intermediary buffering of individual products is proposed, which individual products can be utilized for the complete filling of containers. It is however disadvantageous, that the performance for buffering and extracting individual products by means of one or more pickers into and from an intermediary buffer is to be deducted from the overall performance of the picker line.

Further comparable systems are known from EP 1,160,166 B1 for the simultaneous handling of upright and recumbent individual products, and from FR 2754239 A1 regarding separate product conveyors for different individual products. None of these systems does propose a new approach regarding the problem statement that was indicated at the outset.

A further generic method is disclosed in EP-A-0 856 465. There, individual products and containers are guided on parallel transportation devices for the individual products and for the containers along a picker line in countercurrent. In case of single or multiple intersections of the transportation devices, the running direction of the product transportation device and of the container transportation device is likewise chosen such as to maintain the countercurrent mode of action. Thereby the relative speed of the irregularly supplied products in relation to the supply of containers, but also the delivery of the next container to be filled is controlled by the controller of the last, or in case of failure the last but one, picker in such a manner that only completely filled containers leave the work area of this last picker. Thereby both the gripping of individual products and the placing of individual products are realized, as shown in DE 42 08 818, by synchronizing the picker to the moving product conveyor or container conveyor. EP 0,856,465 B1 further describes that no individual products should leave the work area of the last picker in direction of the individual product flow. The summary of the invention of EP 0,856,465 B1 discloses several methods of how this is being achieved. Paragraph 61 and 62 describe that the controller of the last picker in moving direction of the container belt, or in case of breakdown of this last picker the last but one picker reduces the speed of the container transportation device if otherwise an incompletely filled container would be discharged from the working area of this last or last-but-one picker. Paragraph then describes that thereby the containers located in the workarea of the preceding pickers are being filled to a higher level or even completely by these preceding pickers. Since the performance of all pickers can be used up to the entire filling of the containers in case of a reduced speed setting of the container transportation device, it can be ensured that no unhandled individual products leave the transposition area of the picker line.

Further it is known from EP 0,856,465 B1 that the described principle can be realized with only a single picker what is often the case with a correspondingly low quantity of individual products to be transposed into containers.

U.S. Pat. No. 6,122,895 and EP 0,856,465 B1 disclose further potential characterizing features. In particular a method is described, by which the delivery of the next container to be filled into the work area of the pickers is dependent on the supply of the required number of individual products.

In summary a picker line according to EP 0,856,465 B1 concerns a combination of several, as required by the number of supplied individual products, additionally required pickers which load as many individual products as possible up to their entire filling into containers and an individually working last or in case of failure of the last an individually working last-but-one picker whose task it is to completely fill containers and to discharge the container after complete filling and to deliver a next container to be filled into the picker line.

This method is particularly suitable for picker lines where the supply of individual products is often completely interrupted and where the product transportation device cannot be stopped or at least decelerated in area of the picker line. It then is required that all pickers transfer as many individual products as possible since due to the complete interruption of the supply of individual products the container transportation device remains in stoppage since no completely filled containers can be discharged from the working area of the last picker, but still in the rear area of the picker line individual products have to be transferred into containers. As soon as individual products are supplied on the product conveyor again, this subsequently results in an unavoidable accelerated motion of the container transportation device, since the last picker in running direction of the container transportation device cannot operate as no or just some isolated loading positions are available in the completely or almost completely filled containers.

This method proves to be unfavorable when the delivery of individual products by the majority just fluctuates or if in case of a complete interruption the product transportation device can be brought to a complete stop in the transposition area of the pickers, which is typically the case. In such cases an excessive utilization of the pickers within certain areas of the picker line and considerably larger speed fluctuations of the container transportation device may result even though the fluctuation in the delivery of individual products would not necessitate this. It is further disadvantageous that while transposing different types of individual products the method requires a sophisticated tuning of the relative speed of the container conveyor belt and of the product conveyor belt for each type of individual product in order to ensure a uniform workload for each picker.

In practice the application of this method still often requires to control the complete filling of the containers after discharging the containers from the transposition area of the picker line. Even though the last picker by means of the control system does ensure that all containers are completely filled, it is from a practical view obvious, that certain individual products are not accurately picked, are damaged during gripping or are not precisely placed in the container. Accordingly it can be assumed that the aim of the complete filling of containers according to this method is theoretically achieved, but in practice an individual inspection is required.

Finally EP 1,226,408 B1 discloses a system with at least two pickers, which system allows forming weight determined containers based on a weight determination of each individually handled product.

EP 1,819,994 B1 proposes a method and a system to form weight determined groups or containers, whereby these groups or containers can be discharged by means of several transportation devices. A particular characteristic is to form different groups of individual products on different transportation devices in order to increase the efficiency of the system. This method proves to be disadvantageous when similar groups or containers have to be formed and where it is required to ensure that all individual products are handled without renewed feeding of not completely filled groups or containers.

EP 0,781,172 B1 does not directly address the weight determined loading by means of a picker line, but presents a method to predetermine the probability that a container can be completely filled based on historical weights of individual products. Thereby it is shown that numerous available individual products are critical for the complete filling of a container.

It is therefore an objective of the present invention to provide a method and an apparatus by means of which a picker line in countercurrent operation mode allows to transfer individual products in containers, such as blisters on a transportation device, cavities of a grouping chain, stacks of individual products transferred by engaged pushers of a grouping chain or deep drawn moulds of a thermoform machine as regularly as possible and which permits an improved efficiency and a balanced operation of the picker line without significantly increasing the effort required to handle the containers to be filled.

This objective is achieved by a method and an apparatus having the features of patent claim 1 and 16, respectively.

SUMMARY OF THE INVENTION

The invention is based on the principle of a cascaded counterflow. The use of a cascaded counterflow allows to adjust the pick performance of each individual picker in a picker line such that a, for example linear or degressive, increase of the filling concentration of the containers is ensured independently of the number of individual products supplied to the picker line in running direction of the container transportation device.

The number of individual pickers in a picker line is determined by the individual products supplied to the system. In case of handling different types of individual products in the same picker line in subsequent lots, the individual product generating the highest workload in the system is determining the number of required pickers. Typically the workload is determined by the number of individual products. In certain cases other criteria such as the weight may be determining the workload. As far as the number of individual products determines the number or pickers the dimensioning of the picker line is done according to the following scheme. In a first step the average cycle time for an individual product is calculated. The resulting average cycle time is determined by the handling time while picking the individual product and placing it, by the travelling time between the pick and place location, by the distribution of the individual products on the product conveyor, and by the size and geometry of the work area of each picker. The resulting approximated average cycle time and the maximum number of individual products supplied to the system determine the minimum number of pickers required. In practice this value is adjusted by a safety factor to compensate for interruptions resulting from missing containers, bad individual products, picker stops due to contamination, problems with product detection, or others.

Additionally the transportation device for the individual products can typically be stopped within the transposition area of the picker line.

The transposition area of the picker line is the entire area in which the individual products to be handled are detected and transposed into the containers for becoming filled. In contrast the work area of a picker is the entire area which is covered by an individual picker. The work areas of individual pickers can be overlapping. The transposition area of a picker line is made up of the sum of the workareas of the individual pickers.

According to the present invention the filling of the placing positions of each container in a picker line with at least two pickers which are operated in cascaded counterflow operation is realized such that the increase of the filling levels of the containers in the transposition area of the picker line is maintained independently and as accurately as possible by each picker.

Critical for the functionality of the cascaded counterflow operation is that the concentration of the individual products is measured at the entrance of the picker line. Concentration is the relation of the amount of the currently supplied individual products in relation to the maximally expected amount of individual products. Ideally the concentration of the individual products currently present in the transposition area is also taken into account. This measured concentration determines at a given instant, which picker is currently in control of the product transportation device, of the container transportation device and of the transposition performance of the individual pickers.

To the extent that no individual products, this corresponds to concentration 0, are being supplied on the product transportation device at the entrance of the picker line as is the case directly before production start or in case of a production interruption, all pickers are ordered to finalize the current transposition of an individual product and to then move to a standby position. Likewise the transportation device for the individual products and the transportation device for the containers within the transposition area are brought to a complete stop. By means of this stop it can be prevented that a reinstated feeding of individual products results in major variations in the transposition performance of the pickers.

Critical for the uniform capacity utilization of the picker line is the setting of the nominal filling level of the last and last-but-one picker in running direction of the container transportation device for the individual product, which is supplied with the maximum amount expected for the picker line. For this purpose the dimensioning of the picker line must ensure that even when the maximum expected amount of individual products is supplied to the picker line, the control of the container transportation device is not performed by the last picker. Therefore the nominal filling level of the last and last-but-one picker are configured in such a manner that accordingly the control of the container transportation device is performed by the last-but-one picker in order to more regularly utilize the picker line.

As soon as only a few isolated individual products—the concentration is >0 but almost equal to 0—are supplied to the picker line, the first picker in running direction of the container transportation device is performing the control of the container transportation device.

Correspondingly in case of a linear increase of the nominal filling level a picker in the middle between the first and last picker or in case of a degressive increase of the nominal filling level a picker decentered by the degression is performing the control of the container transportation device if half of the maximally expected amount of individual products—corresponds to a concentration of 50—are supplied at the entrance of the picker line.

If the picker line is applied for processing different individual products in batches which differ in the maximum amount of supplied individual products per sort the maximum concentration differs according to this difference.

The transition of the control of the container transportation device to a picker farther back in running direction of the container transportation device due to a concentration decrease is primarily dependent on how big the concentration decrease is. Accordingly measures must be taken to as accurately as possible maintain the, preferably linear or degressive, increasing filling level of the containers. At the same time there must be sufficient transposition capacity in area of the first pickers in running direction of the container transportation device to as completely as possible transpose the individual product on the product transportation device into containers.

Therefore a threshold level for the concentration reduction is determined. If the concentration reduction is smaller than the threshold level, the transition of the control of the container transportation device to a picker farther back in running direction of the container transportation device is shifted synchronously with the location in the infeed of individual products at which the concentration reduction has occurred.

If however the concentration reduction is bigger than the threshold level, then the admissible filling level of all pickers is increased equivalent to the concentration reduction. Thereby it must be taken into account, that the admissible filling level of the first pickers in running direction of the container transportation device must be more increased than the admissible filling level of the last pickers in running direction of the container transportation device.

The increase is performed such as that the last-but-one picker in running direction of the container transportation device must entirely fill the containers. This is to ensure, that the last-but-one picker later can control the picker line until the picker line is equilibrated again. All other pickers may then fill the containers up to a filling level corresponding to the regular nominal filling level of the last-but-one picker. The last-but-one picker will continue to normally operate with the now lower individual product infeed. When the location in the infeed of individual products at which the amount of delivered products has decreased attains the picker farther back, which according to the concentration of the individual products at the infeed of the picker line is controlling the container transportation device, the admissible filling levels of all pickers, except for the last-but-one picker, are set back to the regular nominal filling level. Simultaneously the picker, which according to the concentration of the individual products at the infeed of the picker line would be controlling the container transportation device, begins to continuously check whether this and all pickers farther back in running direction of the container transportation device do exceed their nominal filling level or not. As soon as these pickers do not exceed their nominal filling level anymore, then this picker is taking over the control of the container transportation device from the last-but-one picker.

This process step is to ensure that even in case of a heavy concentration reduction in the infeed of individual products all individual products can be transposed in containers and that in the front section of the container transportation device as many containers as possible can be completely filled and discharged. Thereby a minor overflow may eventually not be prevented, since the containers from the third and thence backward pickers may not be completely filled.

The transition of control of the container transportation device to a picker further in front due to a concentration increase is executed immediately after such a concentration increase was measured at the infeed of the picker line. Thereby it is ensured that even in case of a fluctuating supply of individual products all individual products can be transposed.

All those pickers that have reached their nominal, filling level of the containers and that are located in front of the picker which is currently controlling the container transportation device, go in a waiting position, even though there may be individual products in their work area and the containers in their work area are not yet completely filled. Thereby it is particularly ensured, that individual products reach the work area of the first pickers in running direction of the container transportation device.

The nominal transposition performance of each picker is set according to the maximum expected concentration such that all pickers together have the ability to transpose the individual products completely into the containers on the container transportation device. Further each single picker is set in such manner that he transposes maximally as many individual products into containers as is required to ensure that the desired increase of the filling level of the containers with individual products at each picker of the picker line is maintained while the maximum number of individual products is supplied to the picker line. The increase of the filling level can thereby, depending on the relative speed of the transportation devices for the individual products and for the containers, be predetermined preferably linearly or degressively increasing. The nominal speed of the container transportation device is set so, that the number of deposit positions supplied and introduced per container does correspond to the maximally expected amount of individual products. Ideally this calibration and tuning is performed so as that each picker in continuous operation is capable to transpose the respective amount of individual products. In practice one will consider for different sorts of individual products which significantly differ regarding their maximum concentration, to set the nominal transposition performance of each picker accordingly for each sort of individual products.

The effective measurement of the concentration is performed by means of communication of the current production amount to the picker line or by means of an as accurate as possible measurement with a sensor at or before the entrance of the picker line. A communication of the amount of supplied individual products at a preferentially early stage is advantageous since in case of large concentration variations in the supply of individual products a faster reaction can be realized. As far as the concentration is measured with a sensor, then this same sensor can at the best be utilized to also determine the position and orientation or a different characteristic of the individual products.

A further improvement of the uniformity of the utilization of the picker line and of the as complete as possible filling of the containers can be achieved by taking the distribution of the individual products in the transposition area of the picker line into account.

If the speed of the product transportation device can be continuously adjusted, then the concentration measurement must also constantly consider this speed.

Thereby it is ensured that the picker line always is working as effectively as possible and that the individual pickers are equally utilized. Simultaneously the cascaded control of the increase of the filling level of the containers ensures that no complex precomputation and allocation of individual products to individual pickers for transposing is required. Finally it is ensured that the container transportation device is not exposed to large speed variations.

The speed of the containers at one hand and the speed of the individual products on the other hand relative to each other is consistently controlled by the proposed method and it is further ensured that each container is discharged from the transposition area of the picker line as completely filled as possible.

A further advantage consists in the fact that the container transportation devices can be realized as transportation chains. This means transportation devices allowing for means of transport with which the containers are arranged in fixed distance. Examples are transportation chains with pushers affixed to the chain or thermoforming machines that deliver deep drawn cavities in fixed distance.

Whether both sub-ordinate goals, a preferably complete filling of all containers discharged from the transposition area and at the same time a preferably complete emptying of the product transportation device can be realized simultaneously is amongst others dependent on whether only one sort of products are supplied on the product transportation device or whether several sorts are supplied in, a mixed manner on the product transportation device. In this case a simultaneous realization of both targets is hardly feasible unless the composition of the individual products supplied on the product transportation device can be quantitatively controlled for the individual sorts or unless no specific composition of individual sorts of products in the containers is required.

Further functional advantages become apparent when looking at the system in direction of the travel of the containers. At the entrance of the containers to the transposition area an empty position in the container is always available and at the end of the transposition area and in particular if different individual products are supplied in a mixed manner on the product transportation device then the probability is at its peak that a required product is in the work area of the last picker in working direction of the container transportation device.

This fact is particularly valuable if the individual products that are supplied on the product transportation device which require to be sorted according to certain-criteria based on their individual characteristics and/or their distribution. For example individual products with variable normally distributed weights can be transposed so as to achieve an equal weight loading of the containers.

Since a weight or type determination is executed for each individual product, it is evident that individual product characteristics, such as a serial number or tracking number, are captured and that on the basis of such individual product characteristics containers with one or more defined and therefore known individual characteristics are formed.

In case of arrangement of the containers in fixed distance and therefore in fixed positions on the container transportation device mostly no control of the containers and no control whether certain deposit positions in the container are empty is required, since based on the deposit positions available at the container infeed of the picker line it is known for each container at the beginning of the transposition area at which position—relative within a container as well as absolute along the container transportation device—an empty deposit position, eventually for which sort, which characteristic or which weight, is available.

As far as the containers cannot be supplied in regular distance, the continuous computation of the transposition performance of each picker must factor in that correspondingly the increase of the nominal filling level of each picker can continuously change.

By means of the method and apparatus according to the invention it is ensured while achieving a high packaging performance that the containers are always filled as completely as possible and that the pickers in a picker line operate uniformly, without the need for elaborate and computation intense optimization measures. Further it may be continuously achieved, that preferably all individual products are packaged.

Further advantageous variants of the method and advantageous embodiments emerge from the dependent patent claims.

BRIEF DESCRIPTION OF THE DRAWINGS

In the following text, the subject matter of the invention will be explained by using a preferred exemplary embodiment, which is illustrated in the appended drawings, in which.

All figures use the term robot instead of the term picker.

WAYS OF IMPLEMENTING THE INVENTION

Figure 1:
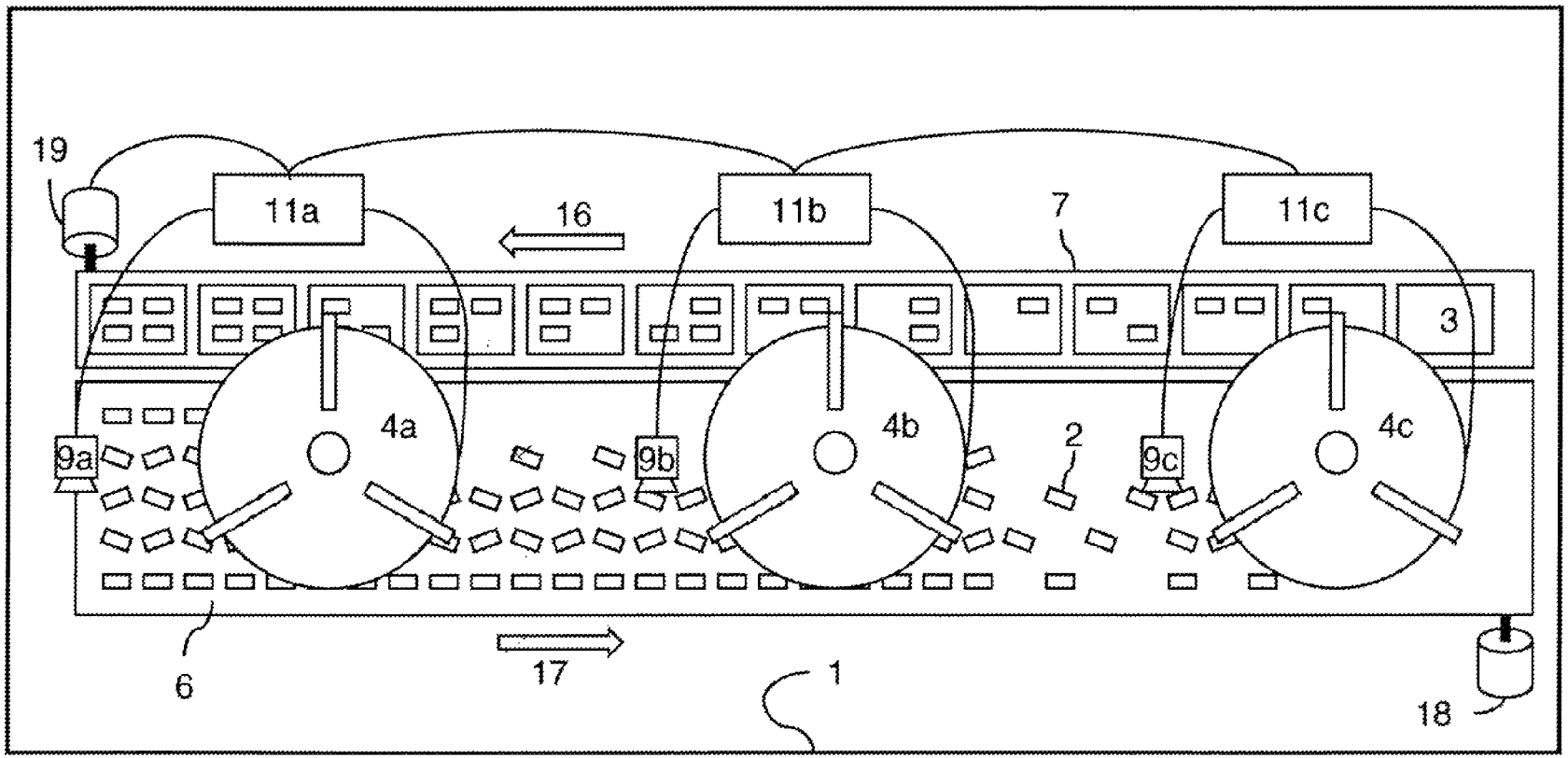
FIG. 1: shows a top view to a picker line in counterflow arrangement, whereby the containers are supplied in regular distance by means of a conveyor chain or a thermoform machine. Thereby each picker is equipped with a picker controller and a sensor.
Figure 2:
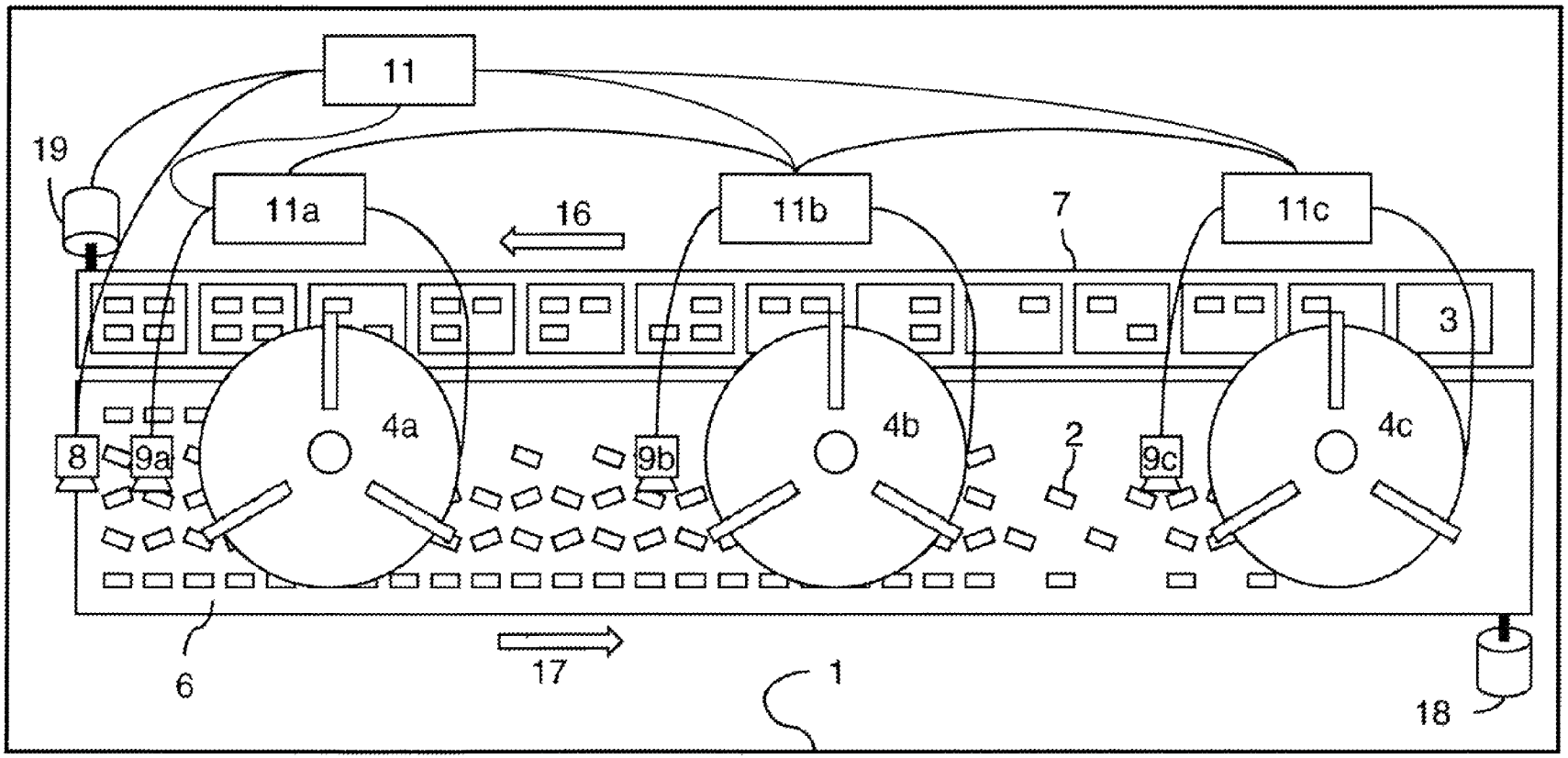
FIG. 2: shows a top view to a picker line in counterflow arrangement, whereby additionally a central controller and a central sensor are shown.

An embodiment according to the invention will be further described on the basis of FIG. 1 and FIG. 2.

In FIG. 1 the product transportation device 6 and the container transportation device 7 are running in counterflow parallel to each other and the containers 3 are supplied in fixed distance. The control 11*a* of the last picker 4*a* is carrying out the central control. Counting and simultaneously the detection of the position and, if required, the orientation of the individual products are carried out with the camera 9*a* of the last picker.

In FIG. 2 an additional central control 11 is applied. The counting of the individual products is carried out with a camera 8 at the infeed of the product transportation device 6.

The container transportation device 7 in FIG. 1 is shown with a motor 19. This motor 19 is connected with the control 11*a* of the last picker 4*a* and the speed of rotation thereof and therewith the speed of transportation movement of the containers 3 on the container transportation device 7 being correspondingly regulated. If instead of individual controls 11*a*, 11*b*, 11*c* for each individual picker a—as shown in FIG. 2—central control 11 for all pickers 4*a*, 4*b*, . . . , 4*n* is applied, then the motor 19 is connected to this central control 11. If the supply of containers is realized with a thermoform machine or with a horizontal flow wrapper, then their respective control is to connect with the control 11*a* of the last picker 4*a*, or alternatively with the central control 11.

The actuator 18 of the product transportation device 6 is shown without interconnection to a control in order to emphasize that the product transportation device 6 is operated at predetermined speed and that accordingly the amount of individual products 2 conveyed on the product transportation device 6 cannot be influenced. In practice the motor 18 is connected to the central control 11 or to the controls 11*a*, . . . , 11*n* in order to have the central control 11 or the controls 11*a*, . . . , 11*n* compute the current speed of the product conveyor 6 for the calculation of the actual position of the individual products 2 on the product transportation device 6 at a given point in time and to ensure that the control can bring the product transportation device to a halt when no individual products 2 are supplied at the infeed.

The actual detection of the individual products 2 is effected with one or more sensors. FIG. 2 shows a camera 8, which covers the whole width of the product transportation device 6 and which counts the conveyed individual products 2 and which transmits the value to the central control 11. Alternatively in FIG. 1 a camera 9*a* is shown at the product infeed of picker 4*a* which also covers the whole width of the product transportation device 6 and which counts the individual products 2 and transmits the value to the picker control 11*a*. In addition the camera 9*a* detects the location, or more specifically the position and orientation, of the individual products 2. If required, this camera 9*a* will only scan a certain area of the product transportation device 6 for location detection. All other pickers 4*b*, 4*c* are also equipped with a sensor, here a camera, 9*b*, 9*c*, whereby these cameras do detect the orientation and position of those individual products 2, which according to the present invention are required for the loading of the containers 3 by the pickers 4*b*, 4*c*. If a high-resolution camera 8 is applied, it can be superfluous to additional cameras 9*a*, 9*b*, . . . , 9*n*. The camera 8 is then detecting the total width of the product transportation device 6 and the central control 11 transmits the results to the controls 11*a*, 11*b*, . . . , 11*n*. Alternatively only a single central control 11 can manage the results and at best also the motion planning of all pickers 4*a*, 4*b*, . . . , 4*n*.

Figure 3:
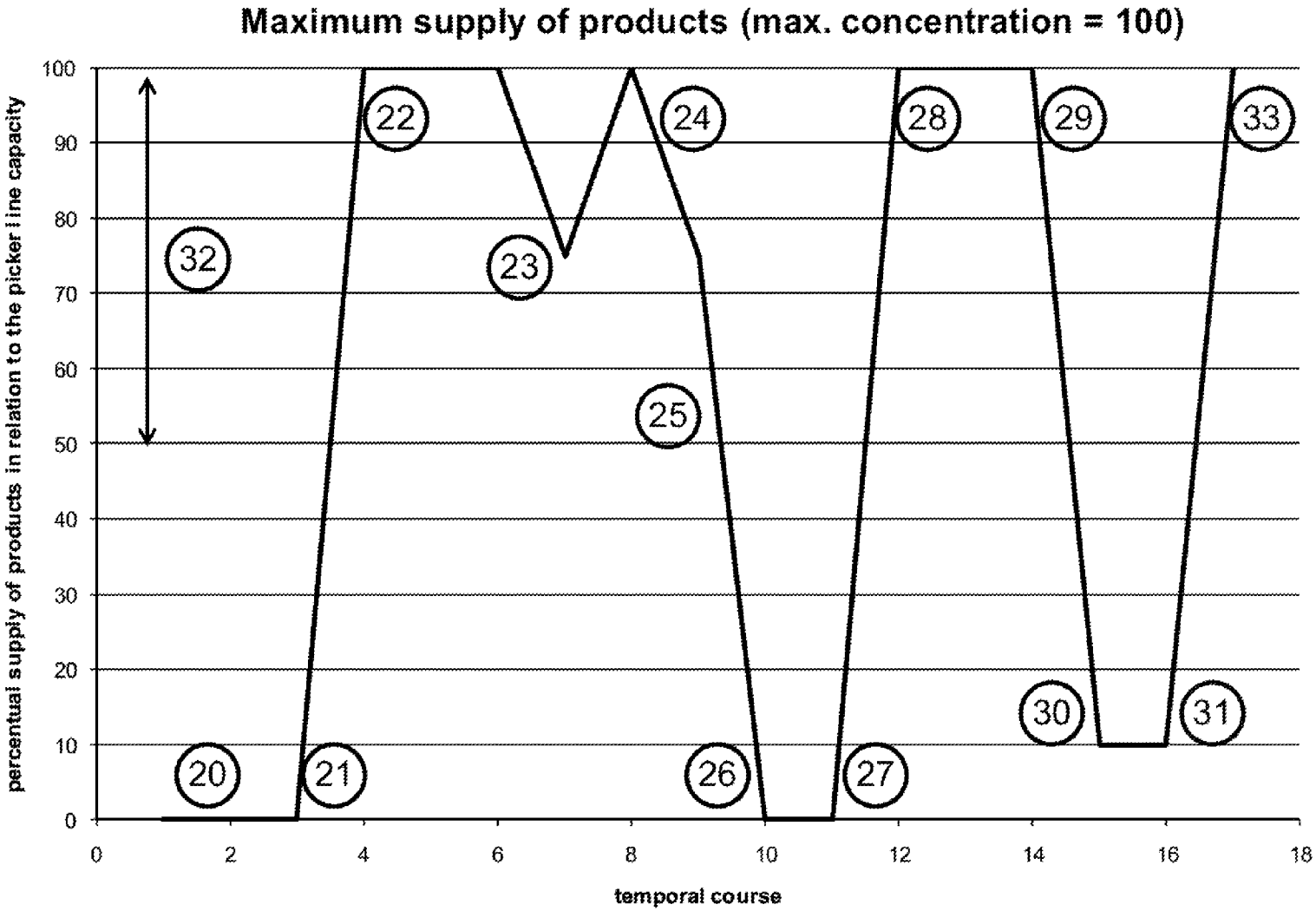
FIG. 3: shows an exemplary progression of the supply of individual products. Here, the maximum supply of products is shown.
Figure 4:
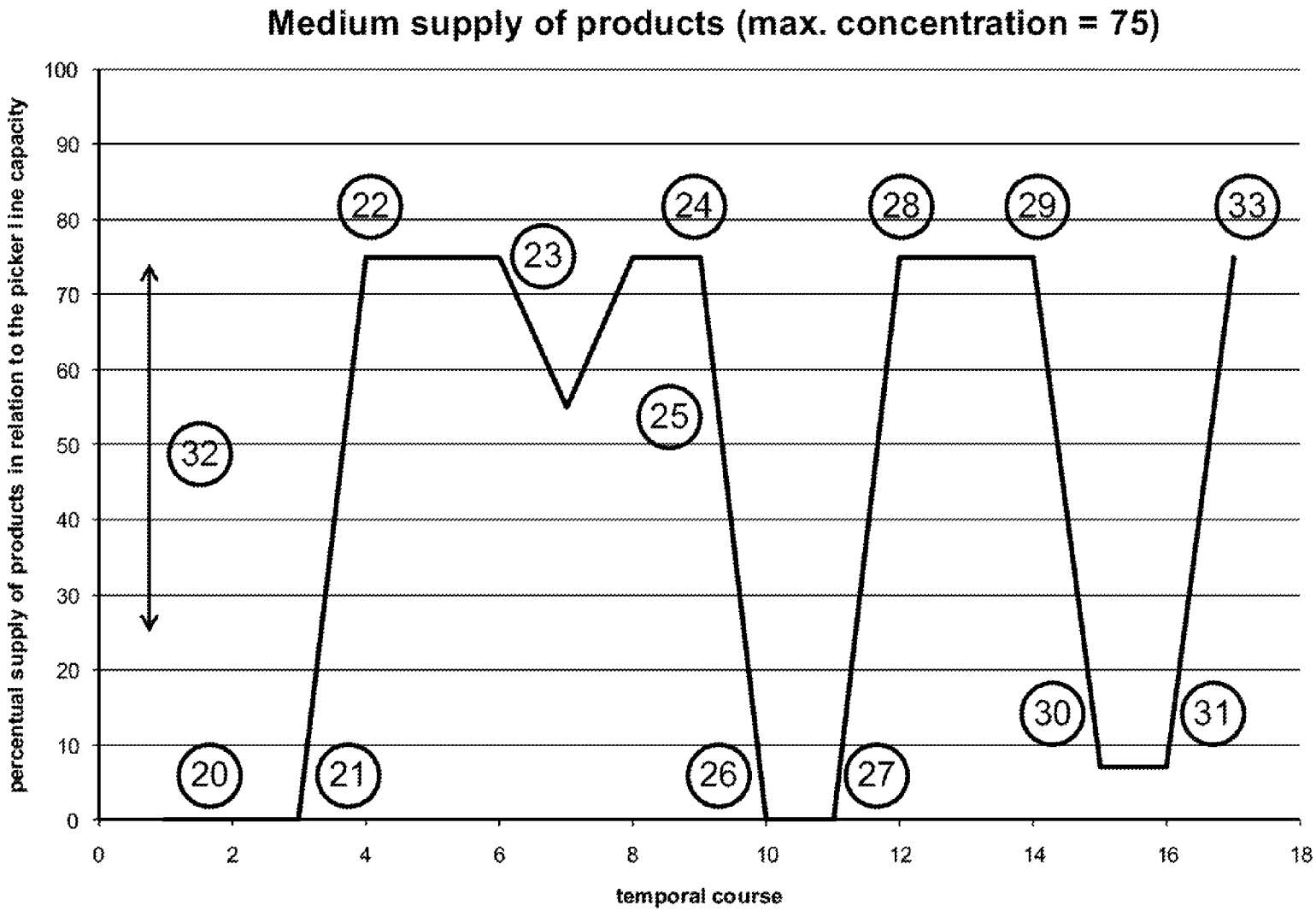
FIG. 4: shows the same with a medium supply of products.
Figure 5:
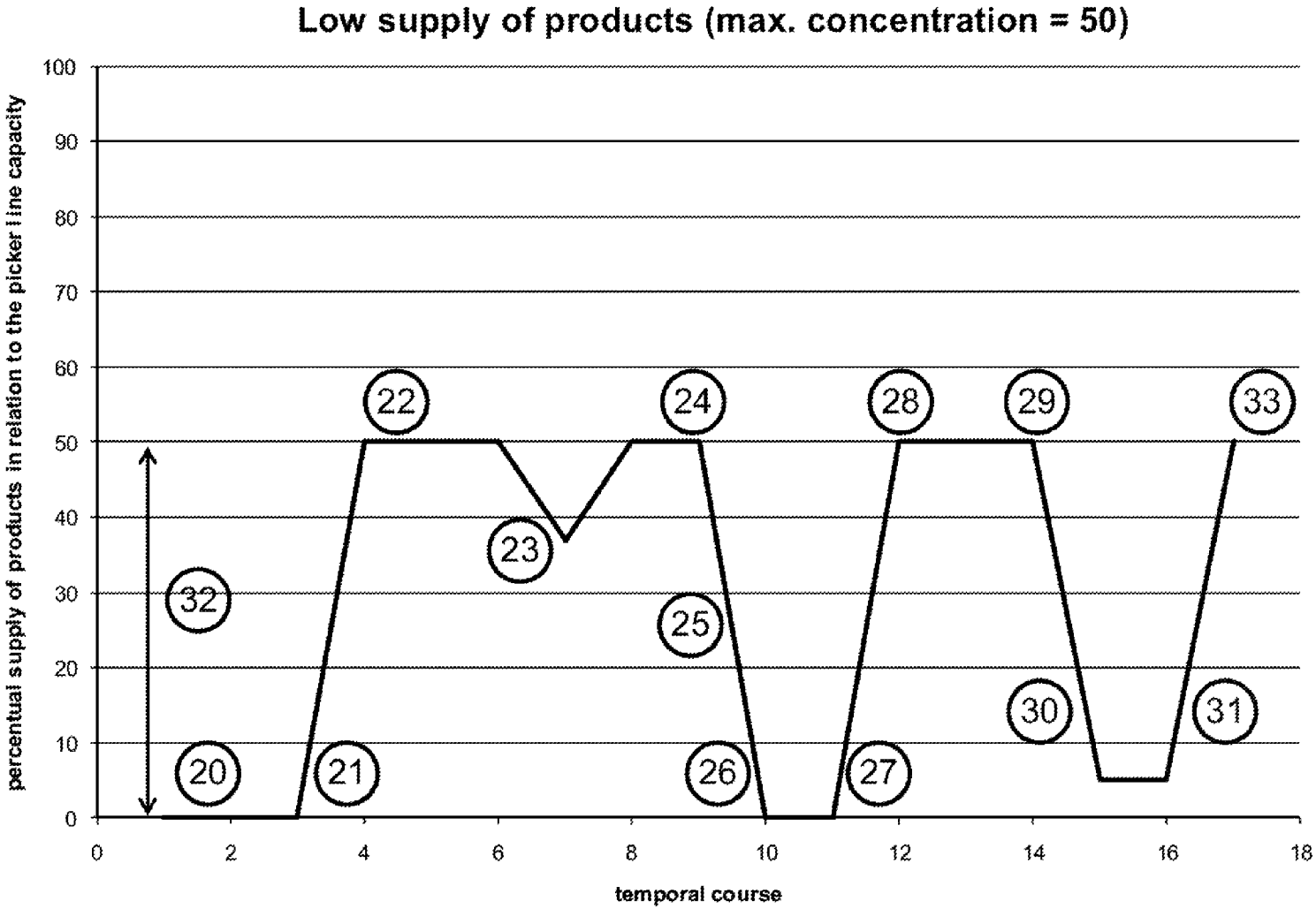
FIG. 5: shows the same with a minimum supply of products.

The underlying method is further described according to FIG. 3, FIG. 4, and FIG. 5. Thereby FIG. 3 shows a schematic distribution for the most numerous individual product 2 which substantially uses the picker line to capacity if the individual products are supplied at their maximum rate. FIG. 4 shows a schematic distribution for an individual product that is supplied at a mean frequency. FIG. 5 finally shows a schematic distribution for an individual product with a relatively low supply, which is not using the picker line to capacity.

The dimensioning of the picker line is based on the sort of individual products, which requires the highest capacity of the picker line 1. In FIG. 3 this is illustrated with the maximum supply (=100) of individual products 2. Based on this maximum supply and based on the size of the containers 3 the number of required pickers 4*a*, 4*b*, 4*n* determined and the nominal speed of the container transportation device 7 is specified. In addition a threshold value 32 is determined. This threshold value 32 determines, how much the supply of individual products 2 may be reduced, to continue controlling the supply of containers 3 the picker 4*b*, . . . 4*n* who based solely on the amount of supplied individual products 2 would control the container transportation device 7. A decrease 23 in product supply which is smaller than the threshold value 32 means that only a shift of the control of the supply of containers 3 to one of the farther back pickers 4*c*, . . . 4*n* is required. A decrease 29 to a current supply 30, which turns out to be higher than the threshold value 32 in contrast means that the control of the last-but-one picker 4*b* is in control of the container transportation device 7. Attention should be paid to the fact that in case of a minimum supply of products as shown in FIG. 5 this situation may not occur since the reduction in the supply of individual products 2 may not drop below the threshold value 32. If a complete interruption of the production of individual products 24-27 occurs, then the product transportation device 6 is commanded to halt and the control responsibility is handed over to the last-but-one picker 4*b*. All pickers 4*a*, . . . , 4*n* go in their waiting position until the instant 27 where new individual products are supplied again. Based on the then supplied amount 28 of individual products 2 a transition of the controller responsibility to one of the pickers 4*b*, . . . , 4*n* is immediately taking place.

In case of a decrease in the supply of individual products 30, which falls below the threshold value and where accordingly the last-but-one picker 4*b* is controlling the supply of the containers 3, two goals are to be attained. On the one hand all products 29, which have been supplied before the drop, must become transposed. On the other hand, the control for the supply of containers 2 at the time of reinitiating of a normal product supply 33 must be passed over to a picker 4*b*, . . . , 4*n* which based on the amount 33 of individual products 2 is responsible for the control of the supply of the containers 3.

Figure 6:
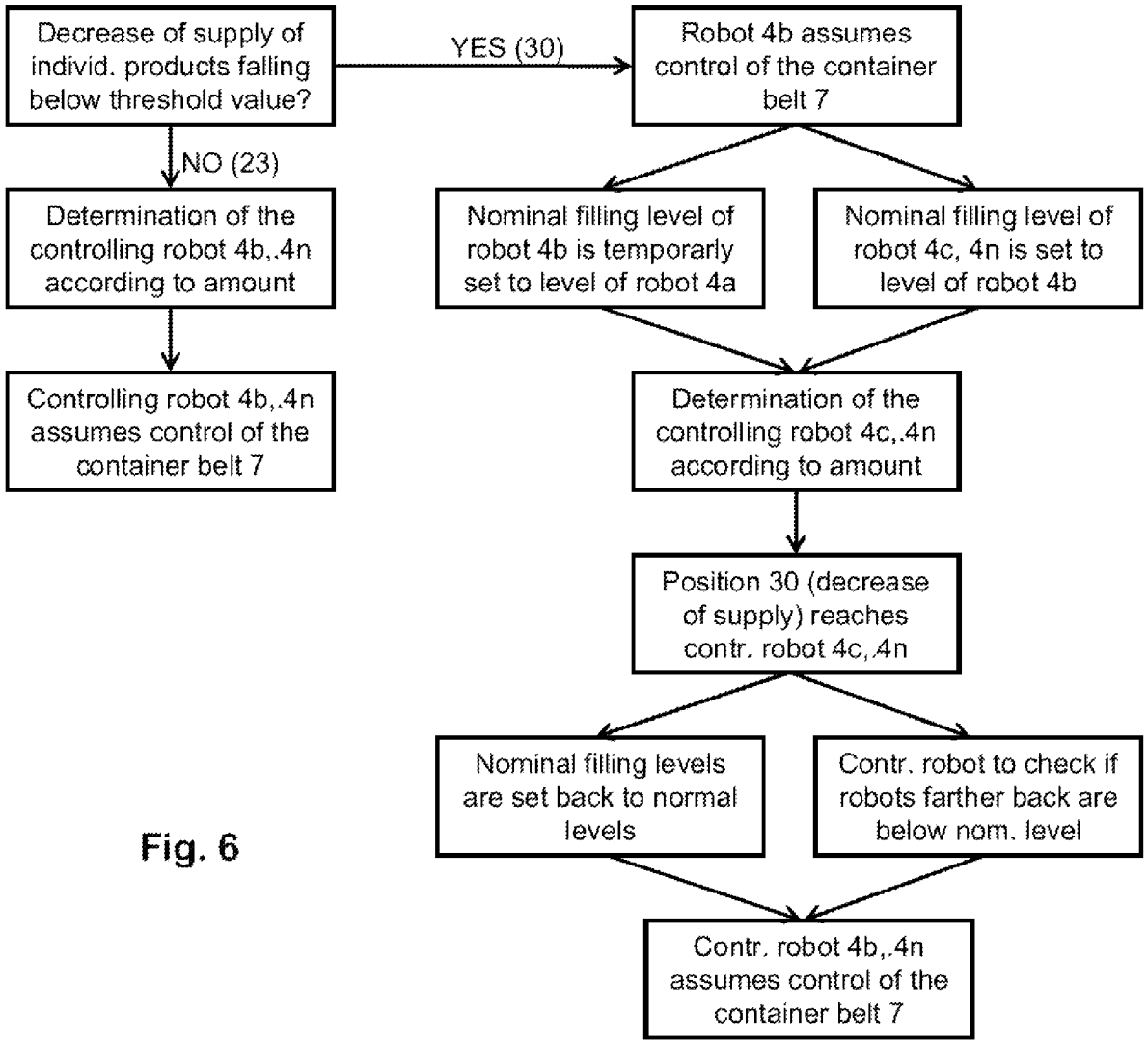
FIG. 6: shows the operating sequence of the threshold level examination.

This transition of control is illustrated in FIG. 6. On the left hand side of the scheme the case according to FIG. 5 is shown, where the decrease in the supply of individual products 30 is not falling below the threshold value 32. On the right hand side the case according to FIG. 3 and FIG. 4 are illustrated, where the decrease in the supply of individual products 30 falls below the threshold valve 32. It is essential, that all pickers 4*c*, . . . , 4*n* are immediately commanded to fill the containers 3 preferably up to the nominal filling level of picker 4*b* and that simultaneously picker 4*b* assumes the control of the container transportation device 7. Only when the position 30 has reached the picker 4*c*, . . . , 4*n* theoretically in charge, the nominal filling levels will be lowered again to their normal level. The then responsible picker takes over the control of the container transportation device 7, as soon as all further back lying pickers as well are lying under their nominal filling level. Up to then picker 4*b* is keeping the control of the container transportation device 7.

Figure 7:
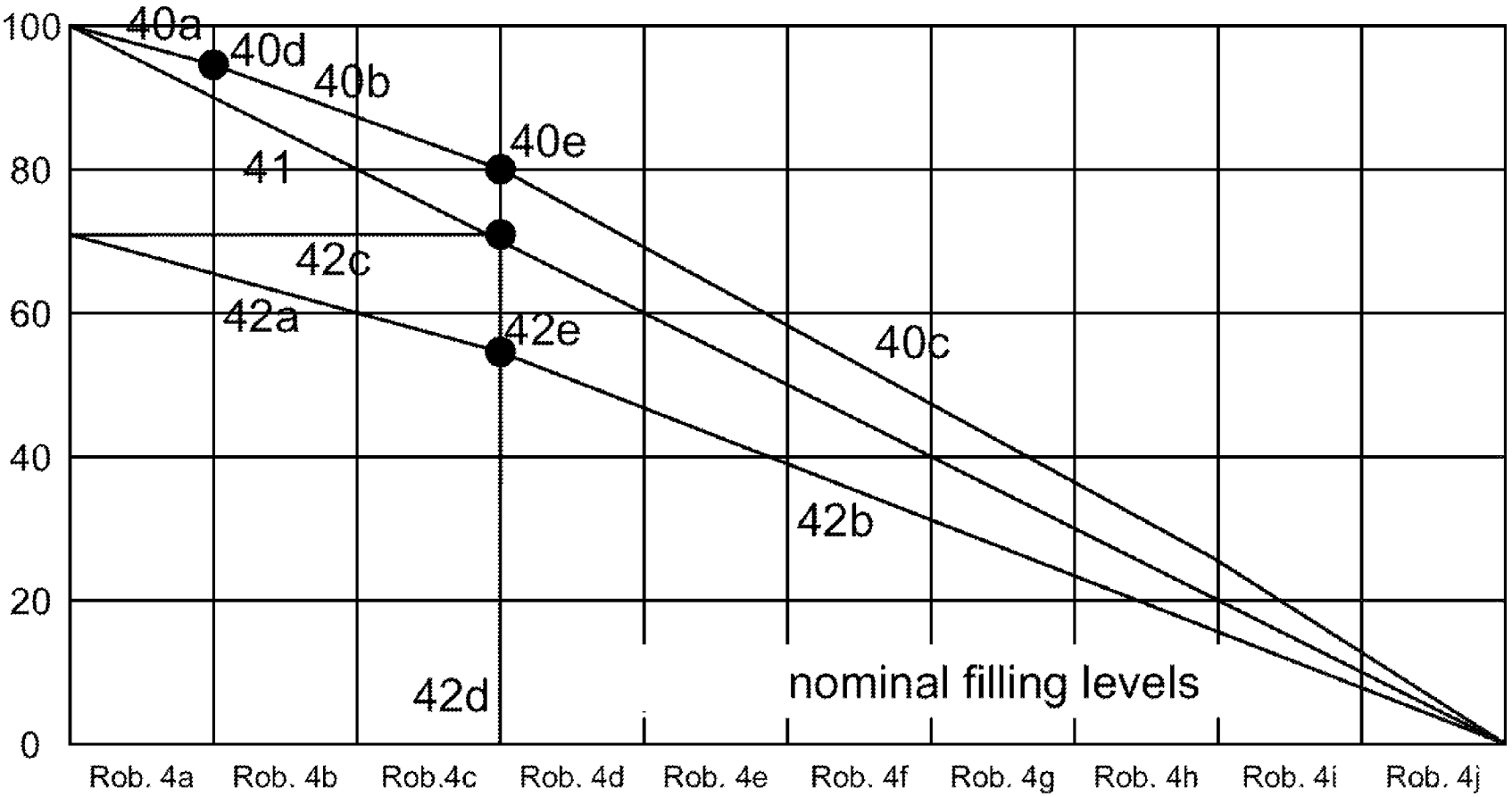
FIG. 7: shows the determination of the nominal filling levels.

The setting of the nominal filling levels is carried out during commissioning and installation of a picker line 1 for each sort of individual products 2. In an exemplary illustration in FIG. 7 for two sorts is shown, how the nominal filling levels are being set. Thereby the curve 41 represents the nominal filling levels for an individual product 2 which by virtue of the expected amount requires the entire capacity 100% of the picker line 1. The nominal filling levels are increasing linearly, since no resources for a declining increase are available. Curve 40 shows a declining increase—labeled as point 40*d* and 40*e*. In case of curve 42 even at maximum supply of the sort of individual products 2 only as many individual products 2 are supplied, that a capacity of 70% is required. Accordingly picker 4*d* is controlling the container transportation device 7 in case of maximum supply of individual products. This specification is illustrated with lines 42*c* and 42*d*. Even though picker 4*d* is responsible, he will not completely fill the container at his position in the picker line 1 but only up to approximately 55% as illustrated with point 42*e*.

The break-down of a picker 4*a*, . . . , 4*n* is not further exemplified with figures. A break-down is compensated on the one hand by adjusting the nominal filling levels of the then working pickers and on the other hand that incase of a breakdown of a controlling picker the picker in direct succession arranged behind the broken picker is taking over the control of the supply of the containers 3.

This method cannot be applied with a single picker 4*a* since the method requires that, with the exception of a drop/decline in the supply of products exceeding the threshold value 32, partly filled containers 3 must be delivered from at least one picker 4*b*, . . . , 4*n* into the work area of picker 4*a*.

The method can also be applied with a product transportation device 6 and a container transportation device 7 that are running towards each other at an angle, as long as the overlapping area is large enough and although such crossing and the resulting difference in level and the reciprocal obstruction of the transportation devices 6 and 7 result in drawbacks that must be accepted.

The invention claimed is:

1. A process for filling containers with individual products by means of a picker line comprising at least two pickers, where the individual products are irregularly introduced in an infeed of the picker line and the pickers individually pick and place the products into the containers within a transposition area of the picker line and where the individual products and the containers are delivered in counterflow on at least one transportation device for the individual products and on at least one transportation device for the containers, said process comprising steps of counting the products as they are introduced at the infeed of the picker line, continuously selecting one selected picker from the at least two pickers, which selected picker will control delivery of containers, based on the number of products counted in the preceding step, and enabling said selected picker to control the transporting of containers into the transposition area of the picker line.

2. The process according to claim 1, wherein distribution of the individual products in the transposition area of the picker line is factored into selecting which picker will control the delivery of the containers.

3. The process according to claim 1, wherein a nominal filling level of the containers is determined for each picker, the nominal filling level of the containers is determined increasingly in a running direction of the containers, each picker that has achieved its nominal filling level and that is not controlling the delivery of the next container suspends its transposition of individual products into containers, and a new container is delivered to the transposition area and the container in the foremost position is discharged when the picker that is currently controlling the delivery of the next container has reached its nominal filling level.

4. The process according to claim 3 wherein for each type of individual products a maximally required transposition performance is determined in advance based on their maximum delivered amount or based on other performance determining criteria, the picker which will control the delivery of the next container in case of delivery of the maximum amount of this type of individual products is determined based on the maximally required transposition performance and the selection of which picker farther back in running direction of the containers that will control the delivery of the next container in case of delivery of less than the maximum amount of this type of individual products is determined based on the maximally required transposition performance and based on a predetermined increase of the nominal filling levels.

5. The process according to claim 4 wherein the next container is delivered to the transposition area by the first picker in running direction of the containers when fewer individual products of a type than the maximally required transposition performance of this first picker are delivered.

6. The process according to claim 4 wherein, when no individual products are delivered, all pickers complete their current transposition of an individual product and go on hold and the transportation device for the individual products is stopped in the transposition area.

7. The process according to claim 4 wherein for each type of individual products a threshold value is determined that corresponds to a maximum value by which the amount of individual products delivered at the infeed may maximally decline such that the picker corresponding to this amount of delivered individual products controls the delivery of the next container.

8. The process according to claim 4 wherein in case of a stoppage of a picker the nominal filling levels of all pickers are adjusted and wherein at least one of the following information is considered to determine the picker which is controlling the delivery of the next container:

the amount of currently delivered individual products, the adjusted nominal filling levels, the amount of individual products in the transposition area, a resulting exceeding of a threshold value.

9. A method of filling containers with individual products using a picker line, said method comprising steps of conveying the products in a flow direction, wherein the products are irregularly introduced at an infeed of the picker line, measuring a rate of flow of said products, conveying the containers in a counterflow direction, providing plural pickers, each adapted to individually pick up products and place them in containers within a transposition area of the picker line, repeatedly selecting one of said pickers as a master picker, depending on said measured rate of flow of said products, and enabling said master picker to regulate said counterflow of containers.

10. A method according to claim 9, wherein if the measured rate of flow is about zero, the selected master picker is the first picker in the conveying direction of the containers.

11. A method according to claim 9, wherein if the measured rate of flow is about 100% of capacity of the picker line, the selected master picker is the last-but-one picker in the conveying direction of the containers.

12. A method according to claim 9, wherein if the measured rate of flow is about 50% of capacity of the picker line, the selected master picker is a picker in between the first and the last picker in the conveying direction of the containers.

13. The process according to claim 9, wherein distribution of the individual products in the transposition area of the picker line is factored into selecting which picker will control the delivery of the containers.

14. The process according to claim 9, wherein a nominal filling level of the containers is determined for each picker, the nominal filling level of the containers is determined increasingly in a running direction of the containers, each picker that has achieved its nominal filling level and that is not controlling the delivery of the next container suspends its transposition of individual products into containers, and a new container is delivered to the transposition area and the container in the foremost position is discharged when the picker that is currently controlling the delivery of the next container has reached its nominal filling level.

15. The process according to claim 14 wherein for each type of individual products a maximally required transposition performance is determined in advance based on their maximum delivered amount or based on other performance determining criteria, the picker which will control the delivery of the next container in case of delivery of the maximum amount of this type of individual products is determined based on the maximally required transposition performance and the selection of which picker farther back in running direction of the containers that will control the delivery of the next container in case of delivery of less than the maximum amount of this type of individual products is determined based on the maximally required transposition performance and based on a predetermined increase of the nominal filling levels.

16. The process according to claim 15 wherein the next container is delivered to the transposition area by the first picker in running direction of the containers when fewer individual products of a type than the maximally required transposition performance of this first picker are delivered.

17. The process according to claim 16 wherein, when no individual products are delivered, all pickers complete their current transposition of an individual product and go on hold and the transportation device for the individual products is stopped in the transposition area.

18. The process according to claim 16 wherein for each type of individual products a threshold value is determined that corresponds to a maximum value by which the amount of individual products delivered at the infeed may maximally decline such that the picker corresponding to this amount of delivered individual products controls the delivery of the next container.

* * * * *